United States Patent [19]

Ringwald et al.

[11] 4,231,719

[45] Nov. 4, 1980

[54] PROCEDURE AND APPARATUS FOR DEGASSING FUEL SUPPLY PUMP

[75] Inventors: Peter Ringwald, Renningen; Klaus Rose, Mundelsheim; Karl Ruhl, Gerlingen, all of Fed. Rep. of Germany

[73] Assignee: Robert Bosch GmbH, Stuttgart, Fed. Rep. of Germany

[21] Appl. No.: 916,415

[22] Filed: Jun. 16, 1978

[30] Foreign Application Priority Data

Aug. 10, 1977 [DE] Fed. Rep. of Germany ..... 2735917

[51] Int. Cl.[3] ..... F04B 17/00

[52] U.S. Cl. ..... 417/366; 417/410; 417/360

[58] Field of Search ..... 417/410, 366, 360; 222/355

[56] References Cited

U.S. PATENT DOCUMENTS

| | | | |
|---|---|---|---|
| 2,832,292 | 4/1958 | Edwards | 417/360 |
| 3,969,044 | 7/1976 | Fussner et al. | 417/410 |
| 3,993,416 | 11/1976 | Kato | 417/366 |

*Primary Examiner*—Richard E. Gluck
*Attorney, Agent, or Firm*—Edwin E. Greigg

[57] ABSTRACT

A procedure and an apparatus are proposed for effectively degassing fuel supply pumps, where the fuel used contains components which vaporize easily at elevated fuel temperatures, and particularly for leading off gas bubbles as they are formed whenever these occur or form in the immediate area of the pump intake. The entire pump and especially the intake area of the pump, which is preferably a roller piston pump, are embodied in open design, with the fuel supply pump arranged perpendicularly and the pumping area located at the bottom, so that gas bubbles forming in the fuel can be carried off before they are introduced into the pump.

The pump comprises a base plate with a telescoping rigid tubular member and an intermediate plate screwed onto the base plate, the intermediate plate having an eccentric boring, which encloses the groove disc of the thus-embodied roller piston pump. Further attached to this intermediate plate is a front cover which secures the entire pump area with respect to a housing surrounding the electromotor and has its interior contour so formed that the front cover can assume the functions of the pump. The base plate and the front cover which secure the pump are cut away in the area of the induction groove of the roller piston pump, so that the groove disc and rollers in this area are open. In this way it is possible to divert any gas bubbles which may be formed while they are still in the immediate intake area of the roller piston pump, so that the formation of large bubbles, which would hinder the induction of the liquid fuel, is prevented.

15 Claims, 5 Drawing Figures

PROCEDURE AND APPARATUS FOR DEGASSING FUEL SUPPLY PUMP

BACKGROUND OF THE INVENTION

The invention relates to a method and an apparatus for degassing and ventilating fuel supply pumps provided with a single or multiple-staged pumping system which are formed as a structural unit with a driving electromotor. Fuel supply pumps are already known in which the fuel pump system, for example a roller piston pump, and the electromotor are both enclosed in a single structural unit in a cup-shaped housing. In this type of structure, the pump is preferably mounted on the collector side of the driving electromotor.

In such electrically driven fuel delivery pumps, gas bubbles can develop, depending on the prevailing fuel temperature in connection with the developing pressure gradient during the induction process; this leads to the formation of an actual gas cushion, which prevents the induction of the liquid fuel.

OBJECT AND SUMMARY OF THE INVENTION

The method and apparatus of this invention have the advantage over the prior art disclosures that as a result of the open design of the pump area in general and of the intake area of the roller piston pump in particular, the latter area being free on both sides, it is possible to carry any emerging gas bubbles freely away from the intake area.

Further advantages of the concept of this invention are that a fuel supply pump so embodied can be installed in the immediate area of the fuel tank of various types of motor vehicles and that the inertia or upward motion of the gas bubbles being formed is utilized in diverting them.

Still another particular advantage of this invention is that the rising gas bubbles are presented with as little resistance as possible because of the particular formation of the front cover securing the pump (roller piston pump) to its forward base plate, which further enables the diversion of any emergent bubbles through the pump chamber on the intake side, since the pump chamber is completely open in the intake area. The base plate and the front cover are cut away in the area of the intake groove and so do not completely cover the groove disc and the rollers fixed therein.

It is also of further advantage that the induction chamber can be optimally filled with fuel over the entire length of the intake groove because of the maximal inflow cross section (when the fuel supply pump is positioned upright) as will be explained in detail later herein.

Generally gas bubbles form either in the induction line of a fuel supply pump or the induction chamber because of localized underpressure or high-temperature conditions. This can also happen as a result of the return flow of fuel over the gaps and clearance volumes from the pressure side to the intake side of the pump.

The invention is particularly advantageously suited to counteracting the formation of all three types of gas bubbles. Since the pumping area is located in the central fuel chamber of a swirl chamber when it is resiliently suspended, the formation of gas bubbles in the induction conduit is prevented at the outset, but the gas bubbles which may form in the induction chamber of the pump may also be optimally diverted as a result of the open design of the pump and in particular of its induction groove area, as has already been mentioned herein. Finally, because of the concept of arranging the fuel supply pump in an upright position flow of fuel from the pressure side to the intake side, which could lead to the formation of gas bubbles, is not possible, since the pumping area is completely enclosed in fuel within the central fuel chamber of the swirl chamber, and gas bubbles float upward instantly, without at any time it being permitted for them to enter the intake area of the pump.

Finally, it is also advantageous that the pump inside the fuel tank is resiliently suspended on an interior ring flange of the fuel tank wall and pointed downwardly and thus does not come into contact with any other part of the motor vehicle which could conduct sound. Further, the resilient suspension of the pump seals off the central chamber of the swirl chamber at the top so that only clean fuel is allowed to pass through a filter and then enter the pump.

The invention thus avoids in an advantageous manner a so-called hot fuel stall (or failure), since gas bubbles arising in the crescent-shaped induction chamber and resulting from leakage at the radial gap of the roller piston pump are carried away at once. In this way the use of new fuels having better anti-knock properties because of a high proportion of components with low vaporization is made possible, since problems which might arise from the formation of gas bubbles are entirely obviated.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
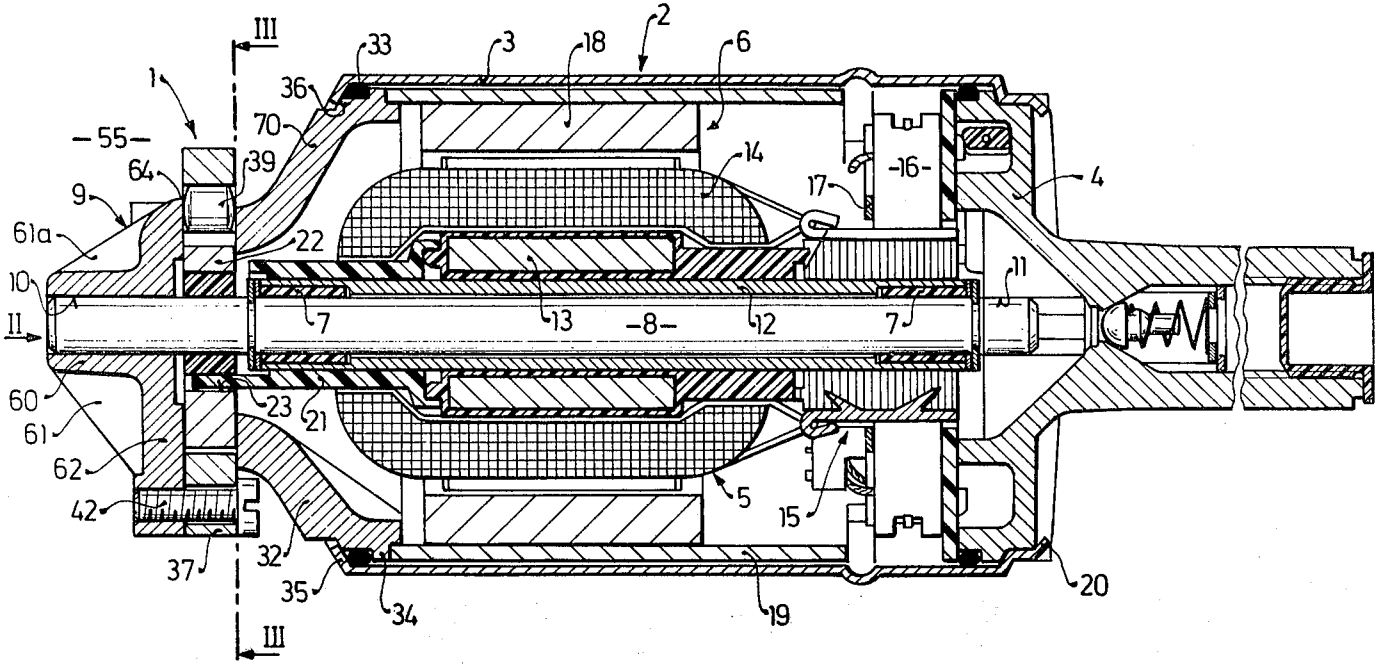
FIG. 1 is a longitudinal and sectional view of a fuel supply pump of the type disclosed by this invention and taken along the lines I—I of FIG. 2.

So that the present invention may be better understood and properly classified technically, the following will first briefly explain, with the aid of FIG. 1, the basic principle, as well as design and operation, of a fuel supply pump using as an example a pump whose pumping area is embodied in one stage, although the invention applies to various types of fuel supply pumps, including those with several pumping stages. It will be noted as the description progresses that the words intake and induction are generally used interchangeably.

The pumping stage of the exemplary embodiment is a so-called roller piston pump 1, whose design and particular embodiment will be described in greater detail hereinafter. An electromotor 2 is attached to the pressure side of the roller piston pump 1 which it drives and is situated in a cylindrical housing 3, which is enclosed in the embodiment shown in FIG. 1 by a cap on its pressure side.

Fuel fed under pressure by the pump 1 also flows through the electromotor 2 and its structural elements, thus effecting a cooling of this device.

The electromotor 2 comprises a rotating armature 5 and a magnetic part 6. The motor armature 5 is fixed by means of fitted bearings, in this example journal bearings 7, onto a rigid shaft, which is firmly pressed into stationary supporting members in the forward and rearward fuel supply pumping areas. In the example shown, a base plate 9 located in the pumping area has a central bore 10, into which the shaft 8 is fitted. The other end of the shaft 8 extends into a fitted bore 11 of the cap 4.

The journal bearings 7 fixing the motor armature 5 on the shaft 8 are situated in a tubular supporting member 12, around which a laminated element 13 and an armature-winding member 14 are situated. Further, there is a commutator bushing 15 located on the tubular member 12 and in this structure is arranged to press against it.

Commutator brushes 16 glide on the commutator bushing 15 and are disposed in cage elements 17. The cage elements 17 are connected electroconductively to connection clamps which are located in cap 4 but not shown in FIG. 1. The magnetic part 6 of the electromotor 2 comprises two permanent magnets 18 located in a tubular or cylindrical holding member 19 made, for example, of magnetically conductive material and being suitably shaped from sheet metal. This holding member 19 serves at the same time to secure at least one stationary structural element in the pumping area 1, since a certain clamping tension is exerted on the holding member 19 by the cap 4, and this force is transmitted through structural elements which are not further described. The cap 4 itself is firmly held on the open end at the pressure side of the outer tube of the housing 3 by clamping means 20.

Generally, a pump for fluids is driven by the electromotor 2 with the aid of a bushing 21 connected to the motor armature 5. The fluid pump can in principle be of any desired type, such as a geared pump, a lateral channel pump, a roller piston pump, or some other kind of pump which would require ventilation. In the example shown, the pump is embodied as a roller piston pump and in this way the rotary motion of the motor armature 5 is exerted on the groove disc 22 of the pump by means of the bushing 21 which includes a tang that fits into a corresponding groove 23 of the roller piston pump.

The pumping system of the fuel supply pump can be embodied in one or two stages, e.g., where the roller piston pump may comprise a second pumping stage when connected either at the outlet side or in series with another pump or when located between the cap 4 and the electromotor 2; the other pump could be of the identical type, or, for instance, a lateral channel pump. The drive of a second pumping stage if there is one, is provided analogously by the electromotor 2. The following description refers primarily to the one-stage pumping system that is shown in FIG. 1, but it is not to be understood as limited only to this system.

Figure 4:
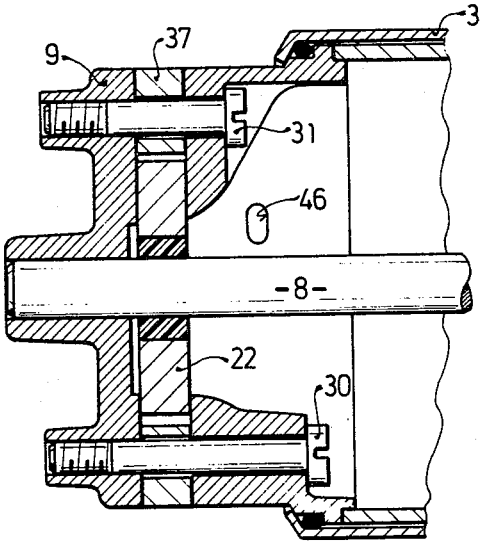
FIG. 4 is a cross-sectional view on the lines IV—IV of FIG. 3.

The roller piston pump 1 of the present embodiment of the invention is arranged as follows, i.e. viewing the structure from left to right in the plane of the drawing, and referring as well to the example shown in FIG. 4. The first base plate 9 is open to the outside and is connected with a bearing plate or front cover 32 by means of at least two screws 30 and 31 (see FIG. 4). The front cover 32 is located for its part below a packing 33 which separates the intake side from the pressure side in the tubular pump housing 3. The front cover 32 is attached in the tubular housing 3 by means of a radially extending annular flange 34, which along with a clamp 35 that is deformed from an end wall of the cylindrical housing 3 that encompasses the O-ring which forms the packing 33 on the pressure side. The front cover 32 is thus held securely and immovably by the arrangement of a cone-shaped ring flange 36 provided by the clamp 35 of the housing 3 and by the pressure exerted on it by the holding member 19.

The base plate 9 and the front cover 32 encompass between them the significant elements of the roller piston pump 1, namely the above-mentioned pump rotor or groove disc and an intermediate disc or intermediate plate 37.

Figure 3:
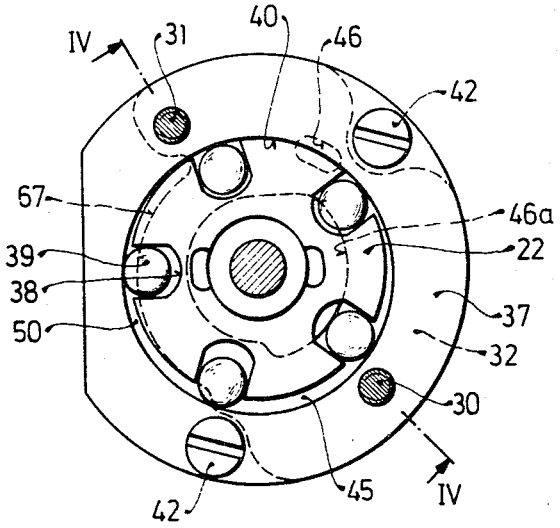
FIG. 3 is a cross-sectional view on the lines III—III of FIG. 1.

The design of the roller piston pump 1 is further such that there are grooves 38 (FIG. 3) in the groove disc 22, in which rollers 39 which serve as pumping elements are disposed in a radially slidable manner. The rollers 39 are guided on their spherical surfaces by the parallel side walls of each groove 38 as well as by the base plate 9 on the one side and the front cover on the other side. The rollers 39 are confined within a circular path 40 (FIG. 3) by the centrifugal force generated by the rotation of the groove disc, said path being formed by an eccentric boring of the intermediate plate 37. The intermediate plate 37 with its eccentric boring is screwed onto the base plate 9 by means of at least two cap screws 42, and by which means the radial gap between the groove disc 22 and the intermediate plate 37 may be precisely adjusted (see FIG. 1). The connecting screws 30, 31, which are shown only in cross section in FIG. 3, are provided with clearance and positioned in the intermediate plate.

Known roller piston pump types are embodied in such a way that the base plate 9 is positioned opposite a cover plate and thus its other, free, side is in contact with the groove disc and intermediate plate. This cover plate is replaced in the exemplary embodiment shown in FIG. 1 by the specially shaped front cover 32, which further assumes the function of the housing 3 as the sole bearer of the roller piston pump with base plate 9. The interior contour of the front cover 32 corresponds to the interior contour of the cover plate which is usually employed, so that the front cover also assumes the pressure groove function.

A significant characteristic of the present invention is that the entire induction area embodied by the roller piston pump is open. A crescent-shaped pumping area, defined by the eccentric positioning of the structural elements of the pump is produced by the eccentric location of the intermediate plate 37 with respect to the shaft 8 and thus to the groove disc 22 fixed to this shaft. This pumping area 45 is reduced in size during operation in accordance with a particular roller 39, so that fuel in the area is put under pressure, in order then to exit the pumping area by way of the pressure ports 46 and 46*a* and thus to enter the chamber of the fuel supply pump. The fuel itself enters the pumping area 45 by way of a kidney-shaped induction port area 50, which overlaps a large crescent-shaped section of the pumping chamber as long as the last-named is enlarging with reference to a particular roller.

Since the design of such a roller piston pump is known in principle, the functioning of such a pump need not be described further here.

It is, however, known and disadvantageous that gas bubbles can form during the induction process, depending on the existing fuel temperature conditions in connection with the pressure gradient being produced, and such bubbles must be delivered away from the induction area of the pump 1. It is important that no vapor lock forms which would prevent the induction of fuel by the pump. This diversion of the gases and vapors, which form under certain circumstances, away from the intake area or in general away from the pumping area, is achieved in the present invention by having the base plate 9 and the front cover 32 cut away in the area of the induction groove or the induction port 50, that is, by having the roller 39 and groove disc 22 only partially covered over and the pumping chamber thus formed open in the intake area.

It is obvious that the chamber 55 which encompasses the pumping stage 1 must contain fuel and from this source the pump 1 draws the amount of fuel to be supplied. Thus the fuel pump shown in FIG. 1 is arranged to extend at least far enough into a reservoir containing fuel that the pump 1 is surrounded with fuel at least up to the clamp 35 of the housing 3. Accordingly, it is possible for the fuel supply pump to be situated in any kind of reservoir in which fuel can be placed or in which fuel is first brought in large amounts from another pump; then the improved fuel supply pump of this invention is in the position of being able to supply fuel free of bubbles.

In an efficient embodiment of the present invention the fuel supply pump is installed directly in a fuel tank and may be completely submerged therein or submerged only to a predetermined depth, all of which will be described in more detail in connection with FIG. 5.

In any case, it will be readily understood at once that the diversion through the open intake area into the space 55 surrounding the pump 1 of any gas bubbles that form can be easily accomplished, even when they form in the pumping chambers between groove disc, rollers, and intermediate plate, as long as the pumping chamber is in the base plate 9 and front cover areas and has not expanded over into the closed areas for the sake of building up pressure.

Figure 2:
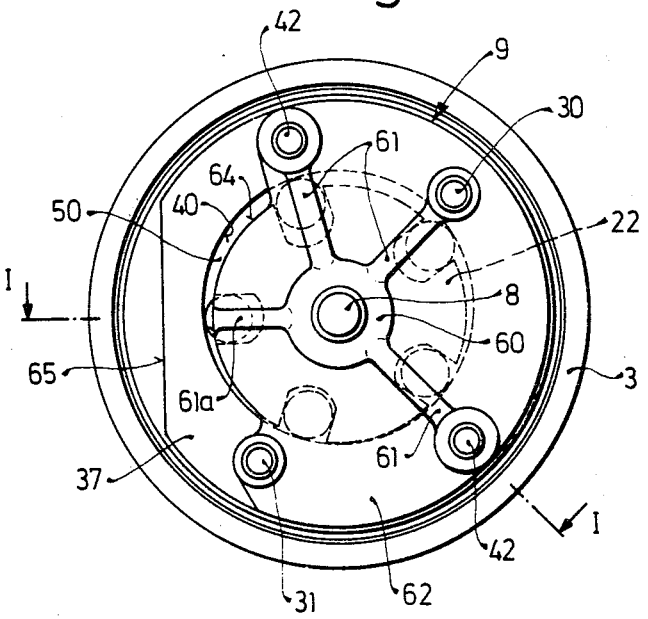
FIG. 2 is a top plan view of the pumping side of the fuel supply pump shown in FIG. 1 as indicated by II.

The design of the individual structural elements comprising pumping stage 1 is as follows. The base plate 9 prior to assembly with the housing 3 is best shown in the view of FIG. 2. The base plate 9 includes a centrally disposed tubular-shaped, elongated member 60, the interior boring of which firmly supports the shaft 8. Individual ribs 61 extend from this tubular member 60 and merge into the exterior wall of the plate-like area 62, which is embodied asymmetrically and has a rim edge indicated in FIG. 2 by the numeral 64. FIG. 2 also shows, with broken lines, the pump rotor 22 with grooves 38 located behind the base plate 9 and with rollers 39 slidably arranged therein. Because of the recess on the pressure side, the intermediate plate 37 may also be seen in FIG. 2; it is cut away at 65 in the manner of a secant. In other words, by what is shown in FIG. 2 in connection with FIG. 1, it can be seen that the base plate 9 is recessed in the area of the more or less kidney-shaped induction port 50 and is shortened in such a way that the pumping area in this section is kept open and the rollers 39, which are in contact with the path 40 formed by the intermediate plate 37, are visible. Thus, the rib 61*a* in this area is also accordingly shortened, as is shown in FIG. 1.

However, it is not only the base plate which is recessed up to the induction port 50, as is seen in FIG. 2, but also the front cover. The broken lines of FIG. 3 show how the front cover 32 is recessed at its rim edge 67, at least in the area corresponding to the recess in the base plate. The fuel supply pump thus appears to be embodied asymmetrically and recessed in this section and both the view of and access to the pumping area are open in the area of the induction port.

Formation of gas bubbles in a fuel supply pump can be classified according to three types depending on how they are formed, namely:

(1) gas bubbles arising in the induction line;

(2) gas bubbles formed in the induction chamber because of localized underpressure or overheating; and (3) gas bubbles arising by the reverse flow of fuel over gaps and clearance volumes from the pressure side to the intake side of the pump, since gas formation is customarily caused by the pressure loss of the medium being supplied.

The present invention is arranged to achieve the removal of all three kinds of gas bubbles. Since there is no particular kind of induction line provided by the invention, but rather this is replaced, in effect, by the fuel in the space 55 surrounding the pump 1, gas bubbles of the first type are diverted from the space 55 or in the embodiment of FIG. 5 into an inflow channel of a turbulence chamber surrounding the pump. Those of the second and third types of bubbles mentioned above are diverted in the area of the induction groove, because this is open on all sides and its positioning does not permit bubbles to remain in the pumping area.

The fuel supply pump of the invention will preferably be employed in an upright position so that the pump 1 has its intake area at the bottom, submerged in the fuel. Logically then any gas bubbles which may form will thus rise as a result of their specific gravity and be particularly advantageously removed, especially since the the cover plate 32 is diagonally formed, as is best shown at 70 in FIG. 1. Gas bubbles can then flow upward along the diagonal wall of the front cover, away from the intake area, when the fuel supply pump is in an upright position. It is even possible for the bubbles to flow through the pressure side of the pumping chamber, because the design of the walls of base plate 9 and front cover 32 at this point insures a particularly good supply to the induction groove area and thus a particularly good filling of the induction chamber with fuel, since the fuel can enter the induction groove from both sides (that is, when the fuel supply pump is upright, from top to bottom over the entire length of the induction groove).

The screws 30 and 31 which connect the front cover 32 with the base plate-intermediate plate-groove disc combination are embodied as pass screws, so that the radial relationship of the front cover 32 with the shaft 8 is secured. These screws 30,31 can be embodied shorter or longer according to structural considerations of the particular pump being used, as is particularly clearly seen in FIG. 4. Further, in FIG. 4 the connection of base plate 9 and intermediate plate 37 with groove disc 22 and front cover 32 is shown without the armature and the bushing.

Figure 5:
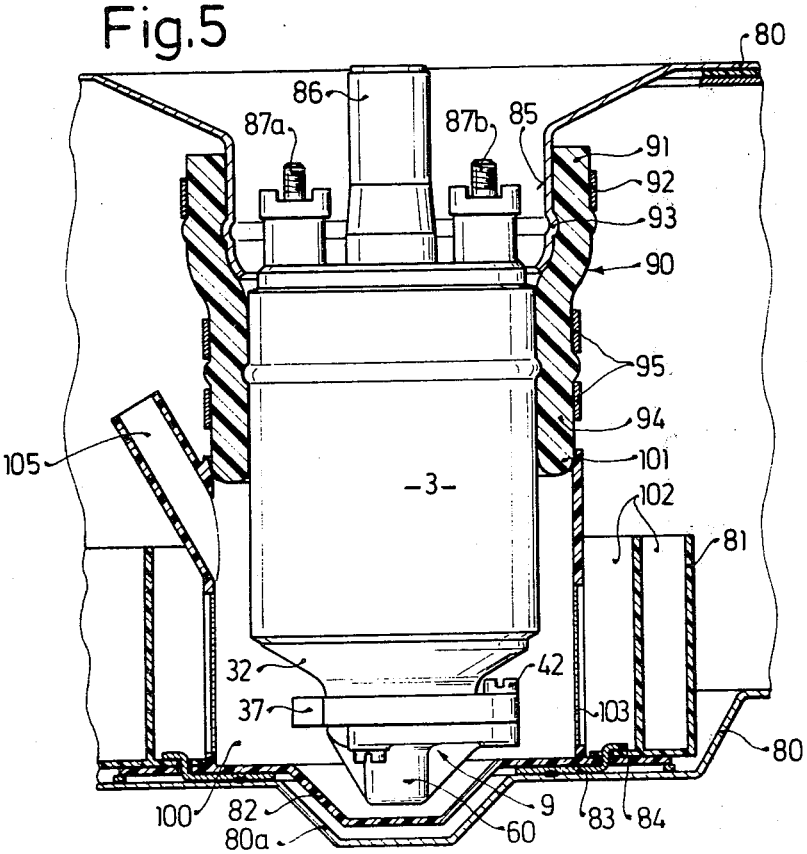
FIG. 5 is a preferred embodiment of the suspension means for the fuel supply apparatus when mounted inside a motor vehicle fuel tank.

The fuel supply pump described thus far is particularly well-suited for direct installation in a fuel tank, as may be seen from the embodiment shown in FIG. 5. The wall of the fuel supply tank is marked 80 in FIG. 5. The fuel supply pump is situated in the middle of a swirl chamber 81 in the tank, which is known per se, and into which any overage of fuel, that is, hot fuel flowing back from the pump, is returned. The tank wall 80 forms a point of greatest depth in the pumping area by means of a bulge 80*a*, into which a corresponding bulge 82 of the swirl chamber 81 is arranged to project. To secure the swirl chamber on the floor of the tank may be done in any suitable manner and as shown in the exemplary embodiment, sheet-metal holders with hook-shaped extensions are fixed, overlapping the bottom of the swirl chamber 81 and thus these elements secure it against sliding. The fuel supply pump, suspended in the tank, dips into the swirl chamber 81, and the tubular projection 60 of the base plate 9 extends into the bulge 82 of the swirl chamber 81. The fuel supply pump is resiliently suspended in the tank in such a manner that an upper tank wall section forms a ring-shaped flange opening 85. The fuel supply pump is set into this flange opening 85 so that its pressure connection 86 projects outward and makes possible the introduction of a suitably fitted pressure hose. The corresponding connections 87*a* and 87*b* also project freely toward the outside in order to carry the supply voltage for the electromotor. The actual suspension means 90, which is generally cylindrical, is fastened exteriorly of the flange 85 that is formed from the tank wall, in such a way that an upper cylindrical section 91 of the resilient material is attached firmly to the flange 85 of the tank wall by means of a holding band or clamp 92 (aided further by a circular protuberance 93 of the flange 85 which is located under the holding clamp 92), while the lower part 94 of the cylindrical resilient suspension means holds the upper part of the cylindrical pump housing 3 by means of one or two ring clamps 95 and elastically supports the housing. The suspension means 90 consists preferably of an elastic, yielding material, for example rubber, a suitable elastomer or other synthetic material; by its connection on one side with the tank wall flange 85 and on the other side with the tubular housing 3 of the fuel supply pump it secures the pump upright and with its pumping area extending downward into the fuel tank. Since the cylindrical suspension means 90 is made of elastic material and the fuel supply pump comes into contact with no other vehicle parts, a superior sound insulation is also thereby achieved.

The elastic pump suspension 90 also seals off a lower fuel chamber 100 formed from the swirl chamber 81 since a lower end portion 101 of the elastic suspension has a portion which projects into the opening of the swirl chamber and has such dimensions that the distance between the circular swirl chamber opening and the housing 3 of the fuel supply pump is thereby bridged over. Exterior inlet channels 102 of the swirl chamber 81, which surround the central fuel chamber 100, are separated from the latter by a filter 103, which admits only clean, filtered fuel into the pump area. This design of the swirl chamber 81 in connection with the pump suspension concept, seals the central fuel chamber and thus assures that only clean fuel can flow into the pump.

In FIG. 5, the lower pumping members, already described fully above, are visible, namely base plate 9, intermediate plate 37, a screw 42 connecting both elements, and the front cover 32. The induction groove opening can induce fuel directly from the central fuel chamber, and in this way any gas bubbles which may form can be diverted almost without resistance upward into the air space in the tank, since, as was also described above, base plate 9 and front cover 32 are diagonally embodied both above and below the induction groove area and since there is a gas bubble diversion conduit 105 located in this area in the wall of the swirl chamber, which provides that the central fuel chamber and the pumping area 1 therein can be ventilated and degassed without difficulty.

In a further advantage of the embodiment, fuel flowing back into the inlet channel of the swirl chamber 81, which in some cases may be hot, is degassed at this point and at the same time mixes with fresh fuel, which is warmed by the returning (hot) fuel and likewise degassed. An immediate re-induction (thick-juice induction) follows, thus using already partially degassed fuel.

In summary, the fuel supply pump according to the invention displays the following important characteristics. The middle housing member embodied as a smooth tube is clamped both to the cap or cover 4 (which is usual) and to the front cover 32, so that the entire pumping area remains open from the front cover downwards (when the entire fuel supply pump is considered to be suspended).

The front cover 32 is the only connecting element holding the pumping area to the housing tube 3.

With the exception of the fact that the pumping area 1 is not surrounded by the housing wall of the fuel supply pump but is instead open in the intake area, the front cover 32 as the supporting member of the pump and the base plate are asymmetrical and drawn back on one side or recessed in such a way that the induction groove area of the pump is open on both sides; in fact, even the individual pumping chambers between groove disc, rollers and intermediate plate make possible the diversion of any gas bubbles formed. The fuel supply pump embodied in open design is fixed upright in the fuel tank with its pumping area at the bottom, so that by using the force of gravity as little resistance as possible is offered to the rising bubbles.

For this purpose the front cover 32 in particular is embodied at such an angle toward the top that gas bubbles flow along it up to the gas bubble diversion conduit 105 which is in the wall of the swirl chamber.

The suspension of the fuel supply pump inside the fuel tank is elastic and yielding in such a way that the fuel supply pump contacts no other vehicle parts, so that there is a superior achievement of sound insulation.

Finally, the suspension also seals off the swirl chamber at the top, so that only fresh, clean fuel can be induced.

The individual characteristics or groups of characteristics, as must expressly be mentioned, represent per se important characteristics and combinations of characteristics which are new (inventive); their effect, even in combination, is to accomplish the single goal of solving the problems resulting from the formation of gas bubbles where the fuel used has components having a low vaporization point, and to secure the trouble-free operation of a vehicle even under difficult conditions.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel pump assembly comprising a cylindrical casing, an electromotor in said casing, perforated front and rear cover elements for said casing, a shaft means arranged to support said electromotor with the shaft means having a terminal portion that extends through said front cover element, said terminal portion arranged to receive a further centrally apertured cover element, said last-named cover element including fuel inlet means and fuel pumping elements having at least one planar wall disposed between said respective cover elements, said front cover element for said casing being a frustum having an asymmetrical front wall and the fuel pumping elements having oppositely disposed surfaces that are exposed to a fuel supply in a sump means.

2. A fuel pump assembly as claimed in claim 1, in which said last-named cover element includes means for supporting said fuel pumping elements.

3. A fuel pump assembly as claimed in claim 1, in which said assembly further includes a fuel tank which comprises a self-contained receptacle having a vertically extending aperture therein and sump means in a bottom wall of said receptacle substantially vertically aligned with said aperture and suspension means disposed in said aperture to support said cylindrical casing with the pumping elements received in said sump means.

4. A fuel pump assembly as claimed in claim 1, in which said pumping elements include a disc having a plurality of radially extending slotways, rollers in said slotways and means comprising an annular plate element encompassing said rollers and said disc.

5. A fuel assembly as claimed in claim 4, in which bolt means are arranged to extend through perforations in said annular plate element and means defining openings in said respective cover elements.

6. A fuel assembly as claimed in claim 4, in which a suction chamber is provided between said disc and said annular plate element.

7. A fuel pump assembly as claimed in claim 1, in which said front cover for said casing has a forward asymmetrical area constricted toward said shaft means, said forward asymmetrical area arranged to abut said planar wall of said pumping elements.

8. A fuel pump assembly as claimed in claim 1, in which said casing is secured to said front cover by a clamping means, a seal member disposed between said front cover and said casing and retained by said clamping means.

9. A fuel pump assembly as claimed in claim 8, in which said front cover is fastened to said further cover.

10. A fuel pump assembly as claimed in claim 3, in which said suspension means includes a resilient member.

11. A fuel pump assembly as claimed in claim 10, in which said resilient member comprises a sleeve-like element.

12. A fuel pump assembly as claimed in claim 3, in which said sump means comprises a swirl chamber which encircles said sump means and said swirl chamber is secured to said bottom wall of said receptacle.

13. A fuel pump assembly as claimed in claim 12, in which said swirl chamber includes a filter means.

14. A fuel pump assembly as claimed in claim 12, in which said swirl chamber is penetrated by a conduit arranged to transport gases away from said pump assembly and upwardly into said receptacle.

15. A fuel pump assembly as claimed in claim 12, in which said swirl chamber includes an upstanding annulus that encompasses a resilient element that encircles said cylindrical casing and forms a seal therewith.

* * * * *